US005447322A

United States Patent [19]

le Masson et al.

[11] Patent Number: 5,447,322

[45] Date of Patent: Sep. 5, 1995

[54] SKI FOR WINTER SPORTS COMPRISING A STIFFENER AND A BASE

[75] Inventors: Jacques le Masson, Cran-Gevrier; Philippe Commier, Annecy, both of France

[73] Assignee: Solomon, S.A., Annecy Cedex, France

[21] Appl. No.: 143,999

[22] Filed: Oct. 26, 1993

Related U.S. Application Data

[63] Continuation of Ser. No. 802,361, Dec. 4, 1991, abandoned.

[30] Foreign Application Priority Data

Dec. 14, 1990 [FR] France ..... 90 16047
Apr. 16, 1991 [FR] France ..... 91 05011

[51] Int. Cl.[6] ..... A63C 5/06

[52] U.S. Cl. ..... 280/602; 280/607; 280/610

[58] Field of Search ..... 280/602, 607, 610, 617, 280/618, 633

[56] References Cited

U.S. PATENT DOCUMENTS

| | | | |
|---|---|---|---|
| 2,258,046 | 10/1941 | Clement | 280/602 |
| 3,260,532 | 7/1966 | Heuvel | 280/11.13 |
| 3,398,968 | 8/1968 | Mutzhas | 280/11.13 |
| 3,797,839 | 3/1974 | Smolka et al. | 280/617 |
| 3,797,844 | 3/1974 | Smolka et al. | 280/617 |
| 3,937,481 | 2/1976 | Koleda | 280/11.35 |
| 4,178,013 | 12/1979 | Kirsch . | |
| 4,577,886 | 3/1986 | Chernega | 280/602 |
| 4,697,820 | 10/1987 | Hayashi et al. | 280/609 |
| 4,804,200 | 2/1989 | Kuchler | 280/602 |
| 4,848,781 | 7/1989 | Dykema et al. | 280/14.2 |
| 4,896,895 | 1/1990 | Bettosini | 280/618 |
| 4,903,979 | 2/1990 | Dimier | 280/628 |
| 4,974,867 | 12/1990 | Ruiller et al. | 280/607 |
| 5,035,442 | 7/1991 | Arnsteiner et al. | 280/602 |
| 5,251,923 | 10/1993 | Stepanek et al. | 280/602 |
| 5,269,555 | 12/1993 | Ruffinengo | 280/602 |
| 5,280,942 | 1/1994 | Ruffinengo | 280/602 |

FOREIGN PATENT DOCUMENTS

| | | |
|---|---|---|
| 373786 | 2/1984 | Austria . |
| 376571 | 12/1984 | Austria . |
| 1270867 | 6/1990 | Canada . |
| 0104185 | 3/1983 | European Pat. Off. . |
| 182776 | 5/1986 | European Pat. Off. . |
| 0409749 | 7/1990 | European Pat. Off. . |
| 0460574 | 12/1991 | European Pat. Off. . |
| 0492658 | 7/1992 | European Pat. Off. . |
| 0564767 | 10/1993 | European Pat. Off. . |
| 810762 | 3/1937 | France . |
| 1118857 | 6/1956 | France . |
| 1269049 | 6/1961 | France . |
| 1407710 | 6/1965 | France . |
| 1433242 | 2/1966 | France . |
| 1467141 | 1/1967 | France . |
| 2109654 | 5/1972 | France . |
| 2409776 | 6/1979 | France . |
| 2433350 | 3/1980 | France . |
| 2639837 | 6/1990 | France . |
| 2654636 | 5/1991 | France . |
| 1578852 | 3/1971 | Germany . |
| 1603002 | 8/1971 | Germany . |
| 2135450 | 4/1972 | Germany . |
| 2259375 | 6/1974 | Germany . |
| 3619118 | 12/1987 | Germany . |
| 8527150 | 1/1989 | Germany . |
| 3933717 | 4/1990 | Germany . |
| WO83/03360 | 10/1983 | WIPO . |
| 8604824 | 8/1986 | WIPO . |
| WO88/01190 | 2/1988 | WIPO . |
| WO88/05324 | 7/1988 | WIPO . |

*Primary Examiner*—Richard M. Camby
*Attorney, Agent, or Firm*—Sandler, Greenblum & Bernstein

[57] ABSTRACT

A ski having a first lower assembly or base, whose front end is raised to form the spatula, and the second upper assembly or stiffener, the two assemblies being connected to one another by a flexible and/or partially rigid connection.

58 Claims, 18 Drawing Sheets

FIG. 6
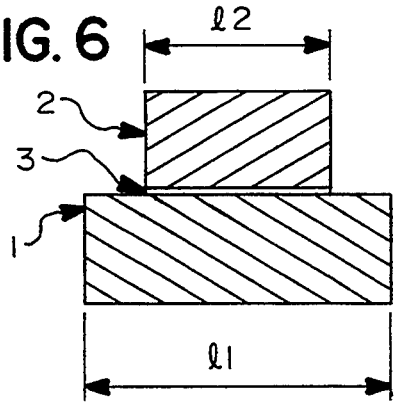
FIG. 7
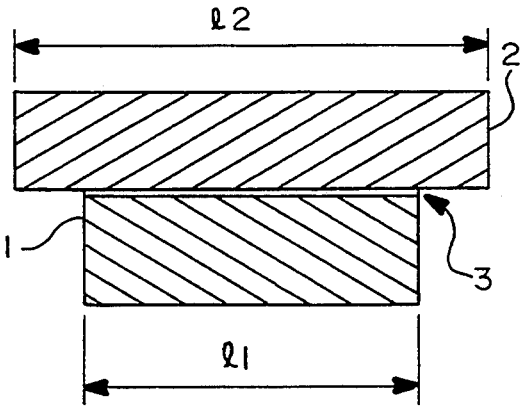
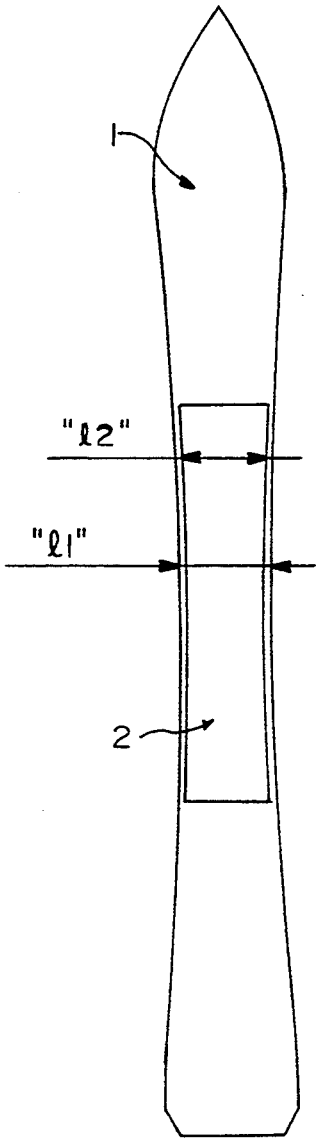
FIG. 8
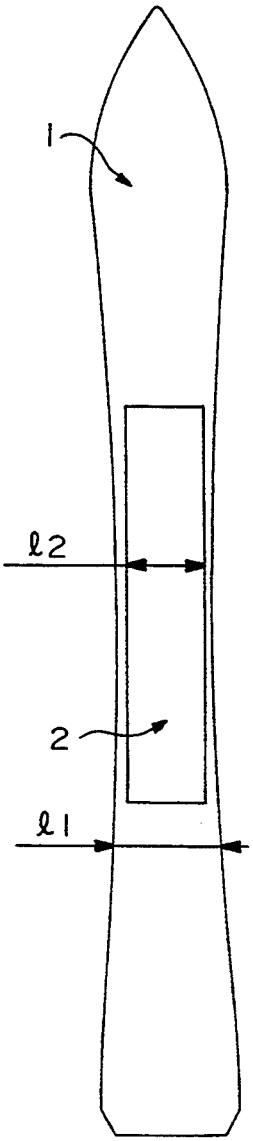
FIG. 9
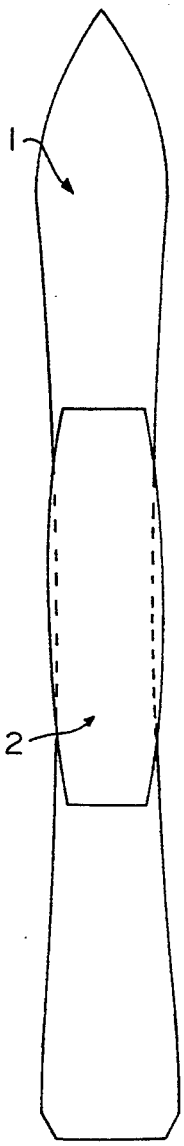
FIG. 10

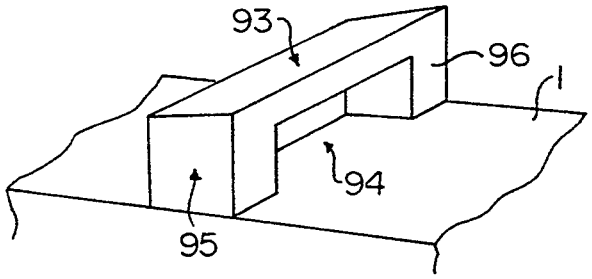
FIG. 43
FIG. 44
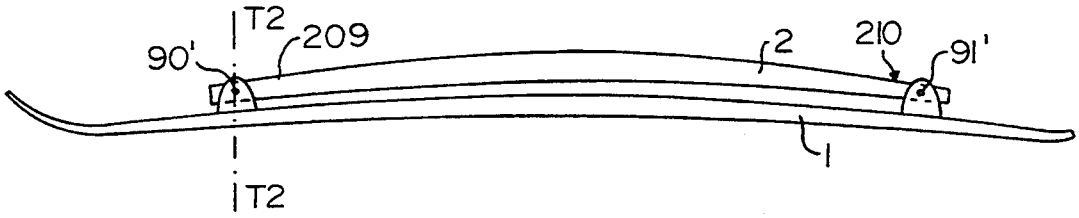
FIG. 45
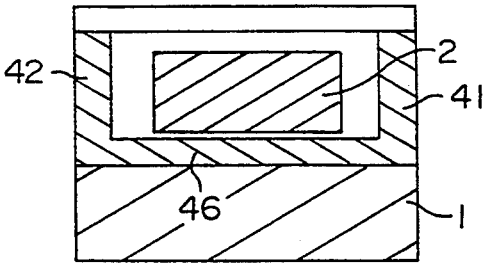
FIG. 44a
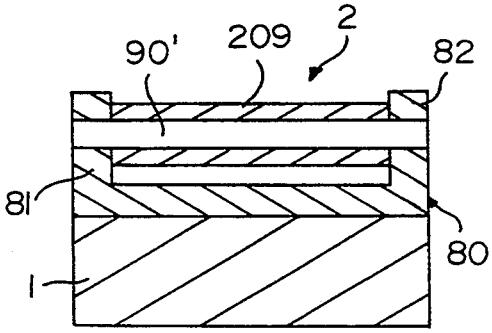
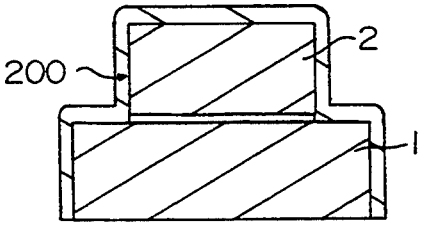
FIG. 46

SKI FOR WINTER SPORTS COMPRISING A STIFFENER AND A BASE

This application is a continuation, of application Ser. No. 07/802,361, filed Dec. 4, 1991, now abandoned.

BACKGROUND OF THE INVENTION

1. Field of the Invention

The present invention is related to a ski, such as an alpine ski, a cross country ski, a mono ski or a snowboard, and particularly concerns improvements thereto.

2. Description of Background and Relevant Information

Many different types of skis are already known, and these skis have numerous variations. They are constituted by a beam of an elongated shape whose front end is curved upwardly to constitute a spatula, the rear end also being slightly curved to constitute the heel.

Currently known skis generally have a composite structure, in which different materials are combined, such that each of them cooperates in an optimal manner with respect to the distribution of mechanical stresses during use of the ski. Thus, the structure generally comprises peripheral protection elements, internal resistance elements to resist flexion and torque stresses, and a core. These elements are assembled by adhesion or by injection, the assembly generally being made by hot forming in a mold that has the definitive shape of the ski, with a front portion substantially raised in a spatula, the rear portion being slightly raised at the heel, and a central arched portion.

Despite ski manufacturers' concerns regarding the manufacturing of good quality skis, they have not, until now, been able to produce a high performance ski that is satisfactory under all circumstances.

SUMMARY OF THE INVENTION

The present invention concerns improvements to these skis, having the object of facilitating their manufacture, that enables the desired characteristics to be obtained, by virtue of the diversity of parameters that may be chosen.

The ski according to the invention comprises a first lower assembly or base, and a second upper assembly or stiffener, the two assemblies being linked to one another by connection means achieved by a flexible and/or partially rigid connection.

According to a complementary characteristic, the stiffener has a length less than the length of the surface of the base in contact with the snow. It is advantageously comprised between 50 and 100% of the length of the base measured between the two lines of contact with the snow.

According to a preferred embodiment, the base and the stiffener are beams of an elongated shape whose height may be variable along the ski such that they reduce towards the front and rear ends.

According to one embodiment, the connection between the base and the stiffener is done by a flexible interface, constituted by a film made of an elastic or viscoelastic material, and extends under the entire lower surface of the stiffener.

According to another variation, the flexible connection is partial and only extends beneath a part of the length of the stiffener.

According to another variation, the connection between the base and the stiffener is a rigid connection and does not extend beneath the entire lower surface of the stiffener.

BRIEF DESCRIPTION OF THE DRAWINGS

Other characteristics and advantages of the invention will become more apparent from the description that follows in light of the annexed drawings, that represent non-limiting examples only.

FIGS. 6 and 7 are schematic views illustrating the ski in a transverse section and according to two variations;

FIGS. 8, 9, 10 and 11 are top plan views showing three embodiments of the stiffener;

FIG. 12 represents a special embodiment of the stiffener;

FIGS. 13 and 14 represent partially flexible connections;

FIGS. 15 and 16 represent partially rigid connections;

FIGS. 17 and 18 represent mixed connections, partially flexible and partially rigid;

FIGS. 36, 38, 39, 40, 41, 44 are lateral views showing variations;

FIG. 43 shows in perspective, a detail of the embodiment of FIG. 41;

FIGS. 44 and 44*a* show a variation of FIGS. 40 and 41;

FIG. 45 is a transverse sectional view similar to FIG. 33 and represents a variation;

FIG. 46 represents a variation of the embodiment;

FIGS. 47 and 48 are simplified transverse sectional views such as that of FIG. 33;

FIG. 49 is a longitudinal sectional view in the support zone; and

DETAILED DESCRIPTION OF PREFERRED EMBODIMENTS

Figure 1:
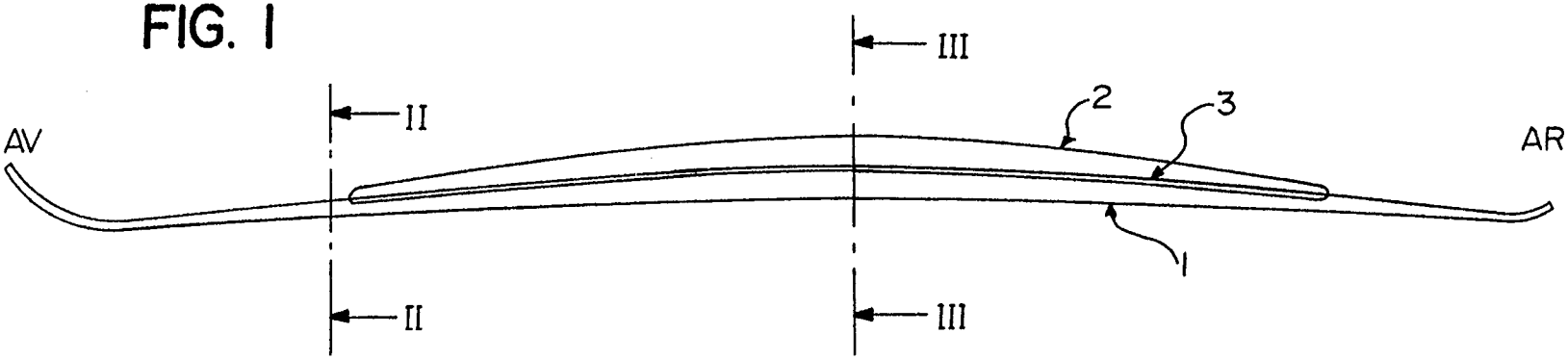
FIG. 1 is a side elevational view of a first embodiment of the ski according to the invention.

FIG. 1 represents a ski according to a first embodiment according to the invention. It comprises a lower assembly or base 1 and an upper assembly or stiffener 2. The stiffener 2 is located above base 1 and is linked to the latter by connection means 3.

The base 1 is the element that is in contact with snow and has the shape of an elongated beam 10, having its own distribution of thickness, of width, and thus of its own rigidity. This elongated beam can have a rigidity that is less than or equal to that of a traditional ski. The base 1 includes a central portion 113 that is slightly arched, and has a lower of sliding surface 114 and an upper surface 115. The central portion 113 occupies most of the length of the base and extends on the one hand, frontwardly by a frontal portion 116 raised to form the spatula 117, and on the other hand, by a rear portion 118, slightly raised to form the heel of the ski. The rear portion 118 is relatively small in length, and is less raised, and on the frontal portion 116 is longer and much more arched, as is well known and represented in the drawings.

Figure 2:
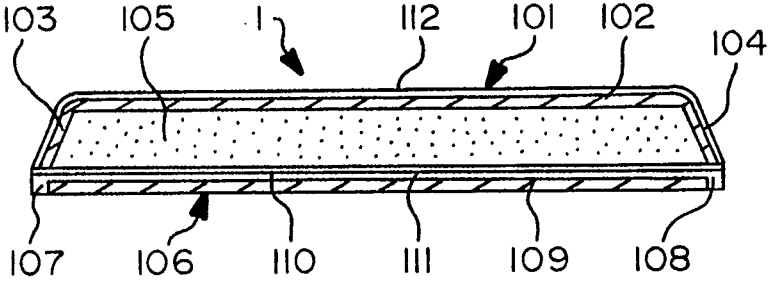
FIG. 2 is a transverse section along II—II of FIG. 1.

The structure of base 1 may be of the sandwich type or of the box or casing type or any other type. In FIG. 2, the preferred structure is represented comprising an upper rigid reinforcement 101 in the shape of a shell with a "U" shaped section forming an upper wall 102 and two side walls 103 and 104, covering a core 105, the assembly being closed at its lower portion by a lower element 106 comprising metallic running edges 107, 108, a sliding layer 109 generally made of polyethylene, as well as lower reinforcement elements 110, 111. An upper superficial layer 112 covers the upper reinforcement to form the decor of the base.

The reinforcement layers 101, 110, 111 may be of any type such as layers of composite materials like fiberglass, carbon fiber with epoxy resin or polyester, or a metallic alloy.

The core 105 may be of reinforced or unreinforced foam, of wood or of an aluminum honeycomb.

The superficial layer ensuring the decor may be of polyamide or any other material, such as a thermoplastic material. It may be single-layered or be constituted of several layers.

According to the invention, the upper surface 115 of the central portion 113 of base 1 is covered by a stiffener 2. This element is adapted to complete the distribution of rigidity of base 1 so as to obtain the desired overall distribution. The stiffener 2 may be of any type, of any shape, and of any structure.

According to a preferred embodiment, stiffener 2 has the shape of an extended portion 20 which also has its own distribution of thickness, of weight and thus of rigidity.

Figure 3:
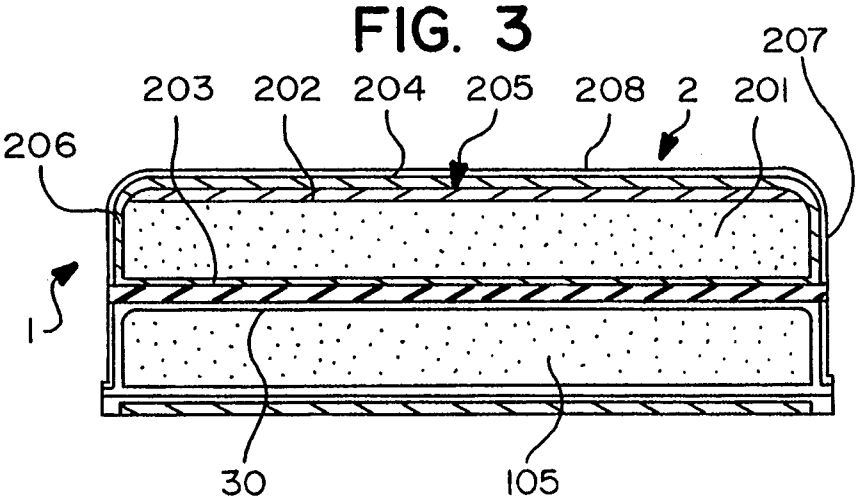
FIG. 3 is a transverse section along III—III of FIG. 1.
Figure 4:
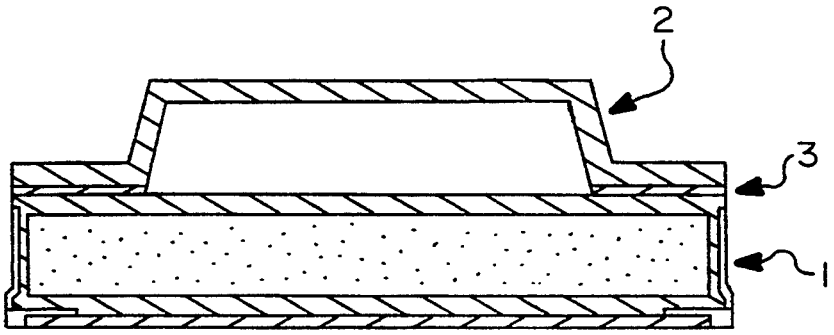
FIG. 4 is a variation of FIG. 3.

In the embodiment given as an example and represented in FIG. 3, the structure of the stiffener is of the box type and is formed of a core 201 located between an upper reinforcement 202 and a lower reinforcement 203. Of course, the structure could also be of the sandwich type, it could, be constituted of a stacking of different elements such as reinforcements and cores. The stiffener 2 may also be constituted by a simple section in the form of an "omega" for example, as is represented in FIG. 4. In this case, it could be provided that the stiffener be made of a composite material by the SRT (Stampable Reinforced Thermoplastic) technique or the SMC (Sheet Molding Compound) technique.

The upper reinforcement 202 is covered by another additional reinforcement 204 in the shape of an inverted "U", forming an upper wall 205 and two side walls 206 and 207. The superficial layer 208 covers the top and the lateral surfaces of the stiffener 2 to form the finish and decor of this element.

As mentioned previously for the base, the reinforcement layers of the stiffener may be of any type, such as layers of composite material like fiberglass, carbon fiber with epoxy resin or polyester or even metallic reinforcements. The core 201 may be of reinforced foam or not, of wood or an aluminum honeycomb. The superficial layer ensuring the decor may be composed of polyamide.

Figure 5:
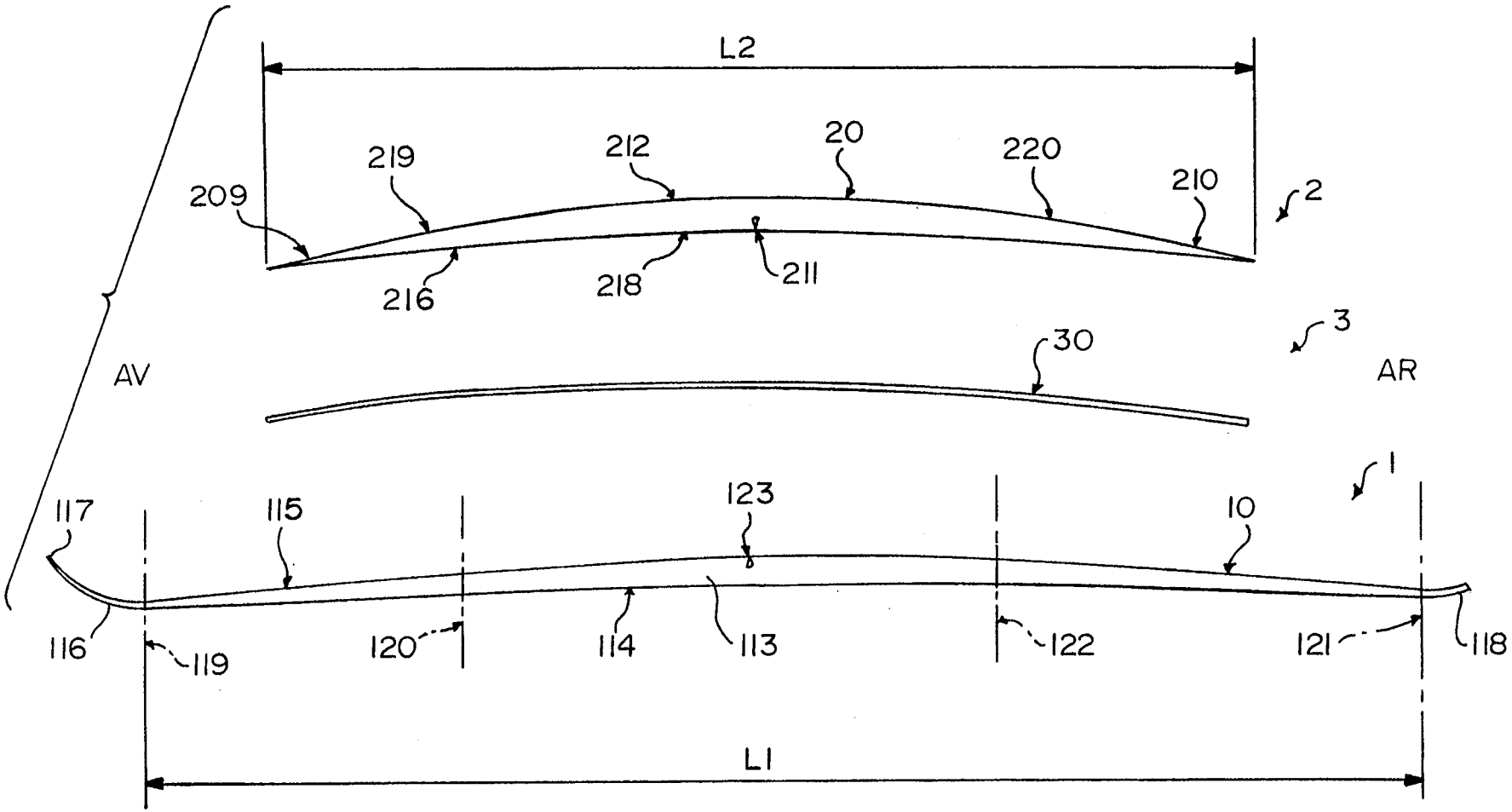
FIG. 5 is a side elevational view illustrating the different components of the ski according to the first embodiment.

According to a preferred embodiment (FIG. 5), the stiffener 2 has a length "L2" less than the length "L1" of base 1. Thus, the front end 209 of the stiffener is located between the spatula contact points 119 of the base and the front end 120 of the normalized zone, or the boot support zone of the binding assembly. Moreover, the rear end 210 of the stiffener is located between the rear contact point 121 and the rear end 122 of the normalized zone of the binding assembly. The stiffener therefore extends beyond the binding assembly zone and, preferably, beyond each end of the binding assembly zone. Thus, if base 1 has a length "L1" of contact with the snow, the stiffener 2 has a length "L2" such that "L2" is less than "L1".

As an example, length "L2" of the stiffener is comprised between 50% and 100% of length "L1". Moreover the relative longitudinal position of the stiffener with respect to base 1 may be, for example, such that the middle 211 of stiffener 2 is at the level of the middle 123 of length "L1" of contact of base 1 with the snow. This can also be otherwise; thus, the middle 211 of stiffener 2 may be more towards the front (AV) or more towards the rear (AR) with respect to the middle 123 of the base.

Insofar as the width of the two elements are concerned, the stiffener 2 may have the same width as the width of base 1, as is represented especially in FIG. 3. But it may also be otherwise; thus, stiffener 2 may have a width "l2" less than the width "l1" of the base 1, and thus be narrower than the latter as is represented schematically in FIG. 6. Moreover, the stiffener 2 may be wider than base 1, as is represented in FIG. 7.

It may also be noted that the widths of the two assemblies, viz., base 1 and/or stiffener 2 may be constant or variable as is represented in FIGS. 8, 9 and 10.

FIG. 8 illustrates in a top plan view an example of the embodiment of the ski according to which the width "l2" of the stiffener 2 is variable and approximately follows the variation of width "l1" of base 1.

FIG. 9 is a view like that of FIG. 8, representing another embodiment according to which width "l1" of base 1 is variable whereas width "l2" of the stiffener is constant.

FIG. 10 is another variation according to which the variation of width "l2" of the stiffener is different than width "l1" of the base that is, when width "l1" of base 1 increases, the width "l2" of the stiffener 2 decreases.

Figure 11:
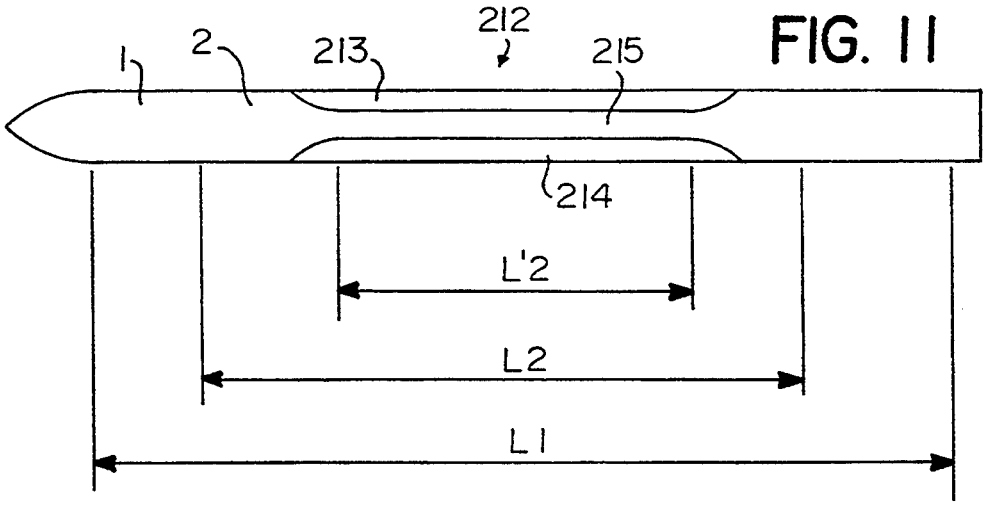

According to embodiments of FIGS. 8–10, the variation of width "l2" of the stiffener is continuous, but may also be otherwise, as is represented in FIG. 11. According to this variation, the stiffener 2 comprises, in its central zone 212, a narrowing of width so as to form two lateral clearances 213, 214 extending along a length "L'2" less than "L2", the stiffener 2 thus comprising a central portion 215 with a reduced width.

Figure 12:
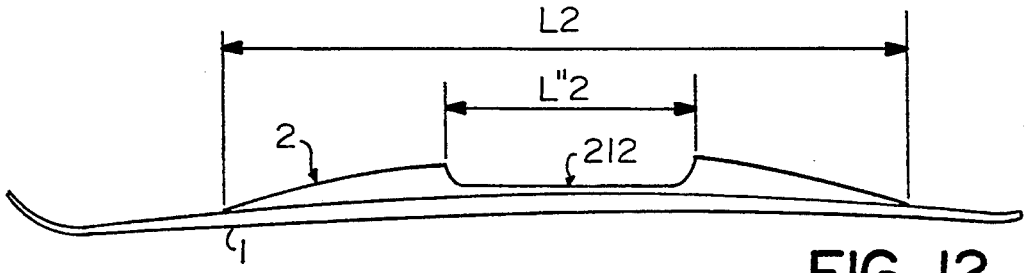
FIGS. 12–18 are side elevational views showing different variations of the connection means.

In the same way, and as is represented in FIG. 12, the stiffener 2 may advantageously be comprised of a lessening of its width in the central zone 212 extending along a length L"2 less than L2. The clearance is thus formed in the region provided for the assembly of the bindings and enables the height between the boot of the skier and the snow to be reduced.

Base 1 and stiffener 2 are elongated portions with respect to heights "h1" and "h2". Of course, in a transverse section, the two heights "h1" and "h2" may have the same value, but may also be different. Thus, in a transverse section, "h1" may be greater or less than "h2". Moreover, "h1" and/or "h2" may be constant in accordance with the longitudinal position at which the measurement is taken. However, in order to obtain a good distribution of rigidity, it is advantageous to vary one or the other of heights "h1" or "h2", or even both "h1" and "h2". Thus, the stiffener may have its height "h2" reduce towards the front and the rear, and even simultaneously towards the front and towards the rear as has been represented. The same applies for the base.

According to the invention, the stiffener 2 is connected to base 1 by connecting means 3 such that the connection between the two elements is flexible and/or partially rigid.

The embodiment represented in FIGS. 1, 2 and 3 represent an example according to which the connection 3 between the two assemblies base 1 and stiffener 2 is totally flexible. To this end, the connecting means 3 are achieved by an interface 30 that is flexible and is located between the two assemblies along the entire length of the stiffener. The interface thus has a width "l2" equal to that of stiffener 2 and a length "L2" equal to that of the latter.

The interface 30 is achieved by a layer of flexible material of the elastic, and especially of the viscoelastic type, with thickness of 0.1 to 5 millimeters, that is adhered or welded on the one hand, on the upper surface 115 of the base 1, and on the other hand, beneath the lower surface 216 of the stiffener. The materials used may be elastic with a Shore Hardness A of 10 to 85, or of a viscoelastic material with an elasticity modulus of 15 to 160 megapascals, and a Shore Hardness A of 50 to 95 and a shock absorption value of 0.13 to 0.72. Of course, this data is only representative of examples, and is valid for temperatures of 20° and frequencies of 15 Hertz.

The fixing of interface 30 on base 1 and stiffener 2 is done either by thermo-hardenable resin such as polyester epoxy, vinyl ester or polyurethane or a thermoplastic film such as polyamide or any other means.

The flexible connection according to the variation described previously is complete and extends beneath the entirety of length "L2" of stiffener 2, but it may also be otherwise. Indeed, the flexible connection may only be partial, and may not extend under the totality of the length of stiffener 2 as is represented in FIGS. 13 and 14.

Figure 13:
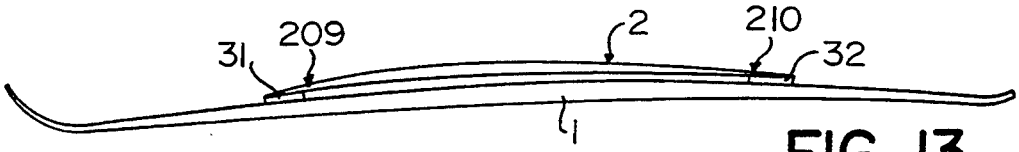

FIG. 13 thus represents a first variation according to which connection 3 is flexible and partial, and is achieved by two flexible interfaces, a first front flexible interface 31 and a second rear flexible interface 32 located respectively beneath the front end 209 and rear end 210 of stiffener 2.

Figure 14:
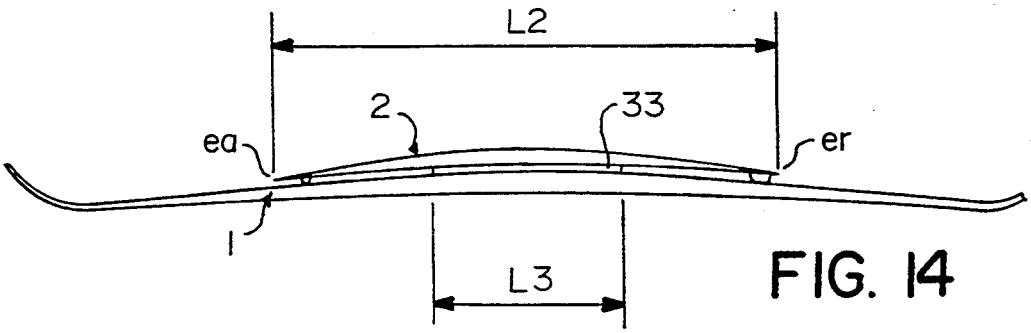

FIG. 14 represents a second variation according to which the flexible connection 3 is achieved by a flexible central interface 33 located between base 1 and stiffener 2 in the central zone of the ski, and whose length "L3" is less than length "L2" of the stiffener, to constitute a partial flexible connection.

Figure 15:
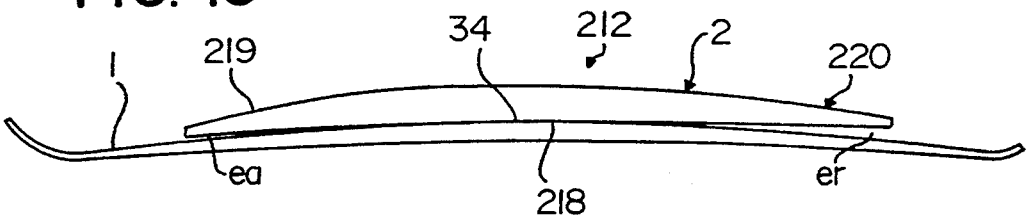
Figure 16:
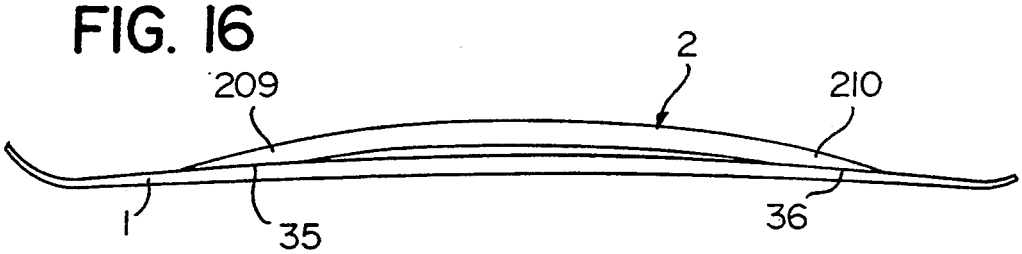

According to other variations, the connection 3 between base 1 and stiffener 2 is partially rigid; that is, the connection, when it is rigid, does not extend under the entire surface of stiffener 2 as represented in FIGS. 15 and 16.

FIG. 15 shows a variation according to which connection 3 is partial and rigid; that is, the stiffener 2 is connected in a rigid manner by its lower central surface to base 1. Thus, only the central portion 212 is fixed to base 1 whereas the front portion 219 and rear portion 220 are free.

FIG. 16 shows another arrangement in which connection 3 is rigid and partial. According to this arrangement, only the front and rear ends 209 and 210 of stiffener 2 are fixed to base 1 so as to leave the central zone 212 free.

The rigid connection 3 may be obtained by any means such as adhesion, or by mechanical connections such as screws or rivets or even welding, especially by ultrasound or vibration welding.

Figure 17:
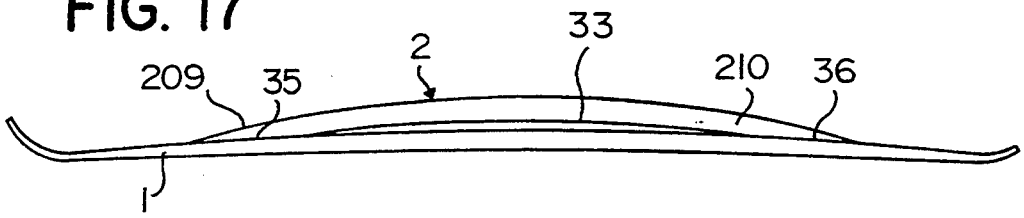

Of course, the connection 3 between base 1 and its stiffener 2 may be mixed, that is, partially flexible and partially rigid as is represented in FIG. 17.

Thus, according to the variation of FIG. 17, the central zone of the ski comprises a central flexible connection 33, whereas the front and rear ends 209 and 210 of the stiffener are fixed to base 1 by two partially rigid connections, a first rigid connection or front connection 35 and a second rigid connection or rear connection 36.

Figure 18:
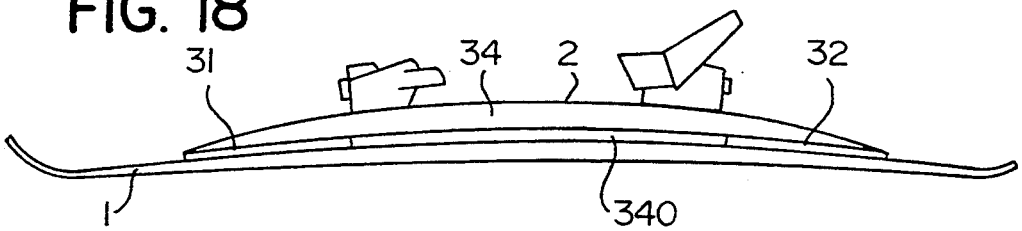

The variation of FIG. 18 is inverted from that of FIG. 17. Thus, the partially rigid connection 34 is at the center as in the variation of FIG. 15, but the front portion 219 and rear portion 220 of the stiffener 2 are linked to the base by partially flexible connections, a first front flexible connection 31 and a second rear flexible connection 32. The central rigid connection 34 may be obtained by a projection coming downwardly from the stiffener or by a central intermediate wedge or central rigid interface 340.

Figure 19:
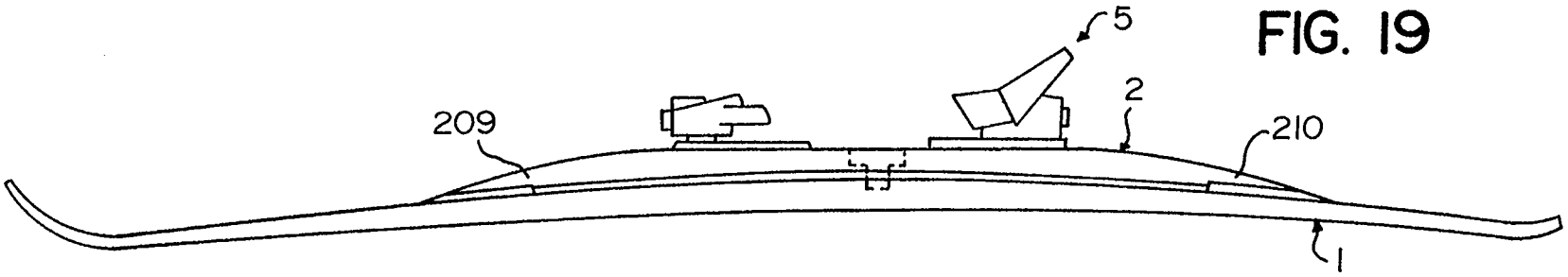
FIGS. 19 and 20 represent a variation of the stiffener fixed by connections at its ends.
Figure 20:
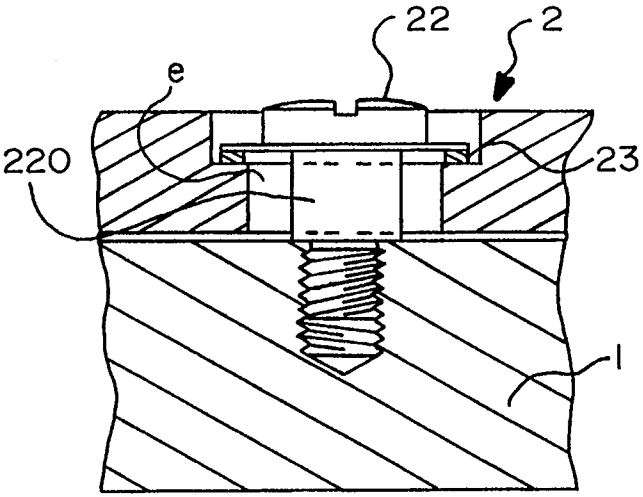

FIGS. 19 and 20 represent an example in which the stiffener is connected to the base by its front and rear ends 209, 210 and in which the bindings 5 are directly connected to the stiffener. Thus, in order to avoid the possibility of the stiffener being torn away, and in order to enable the displacement amplitude of the stiffener with respect to the base to be adjusted, an adjustment screw 22 resting on an elastomer ring 23 elastically connects the stiffener 2 to base 1 in the central portion of the ski.

The longitudinal displacements of the stiffener are rendered possible by providing a space of some tenths of a millimeter in the longitudinal direction between shoulder 220 of screw 22 crossing the stiffener and the internal walls of the hole of the stiffener.

Figure 21:
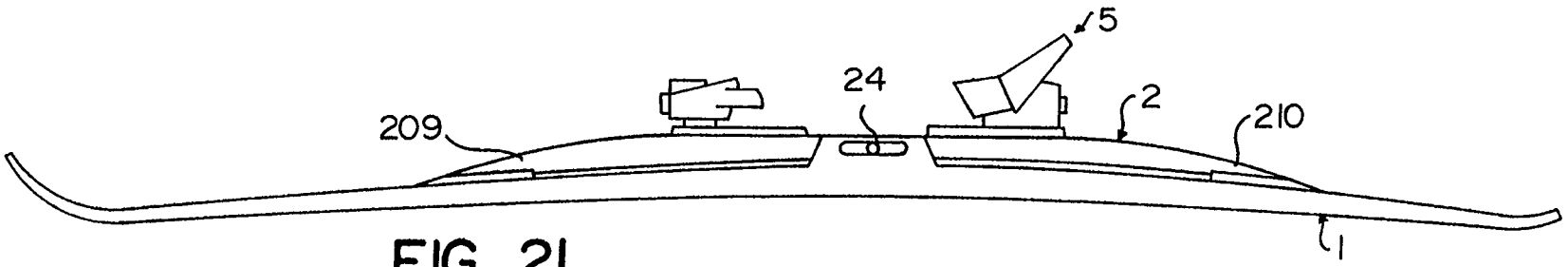
FIGS. 21 and 22 represent a variation of the embodiment of FIGS. 19 and 20.
Figure 22:
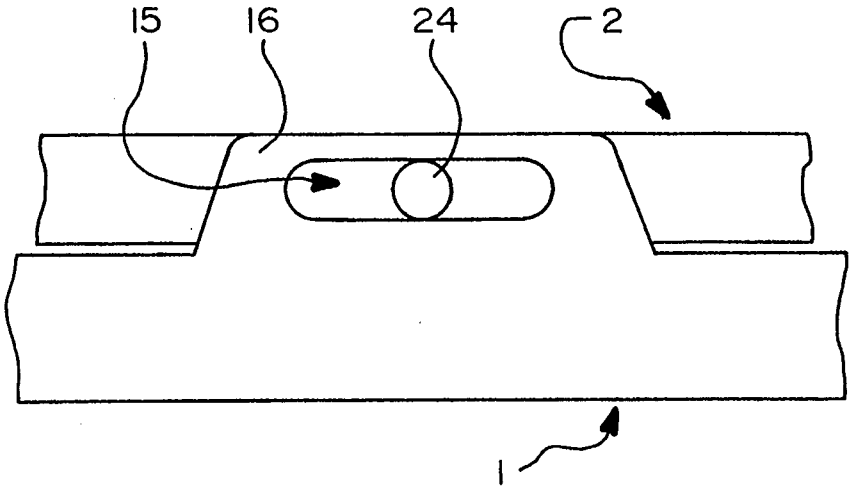

FIGS. 21 and 22 represent a variation of FIGS. 18 and 19 in which the stiffener is connected to the base by a transverse rod 24 affixed to stiffener 2, and each end of the rod takes lateral support in an oblong hole 15 made in the base, and especially, through a lateral edge 16 of the base. The transverse rod 24 is transversely fixed to the base by any appropriate retention means. The longitudinal displacements of the stiffener with respect to the base are rendered possible as in the previous embodiment.

Figure 23:
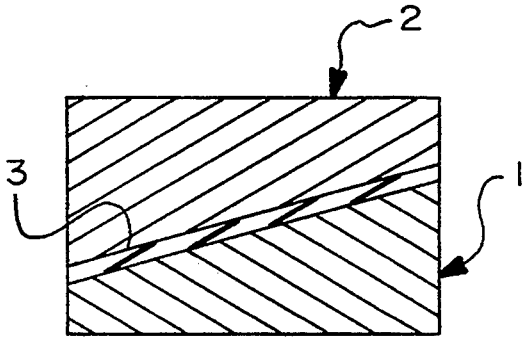
FIGS. 23–27 are variations showing a transverse section and schematic view of other embodiments.

According to the embodiment described previously, the upper surface 115 of the base is a surface whose generatrix is parallel to the lower sliding surface 114. But it could be envisioned that the upper surface 115 be biased and inclined as is represented in FIG. 23 where the connection interface 3 is inclined either towards the inside of the ski or towards the outside.

Figure 24:
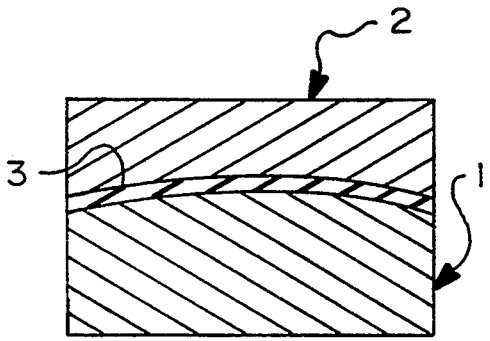
Figure 25:
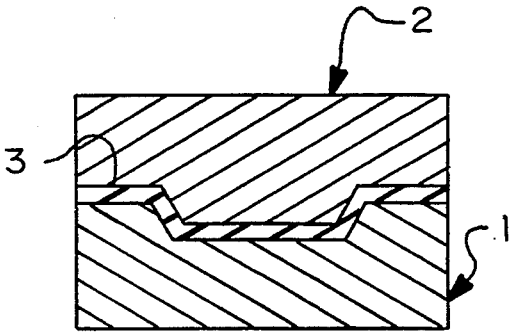
Figure 26:
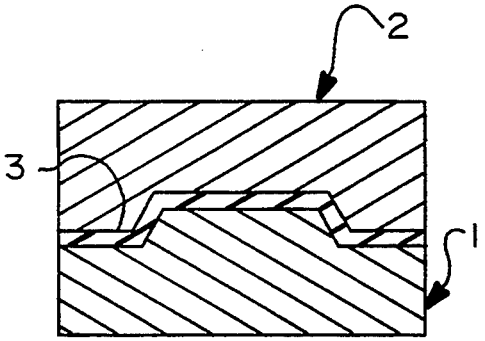

FIGS. 24, 25, and 26 are schematic views in a transverse section of three other variations of the shape of the interface.

According to these different variations, the interface zone is not planar, but has a complex shape. According to the variation of FIG. 24, the interface surface 3 is curved. According to the variation of FIG. 25, base 1 comprises a longitudinal hollow section and the lower surface 216 of the stiffener 2 comprises a corresponding projecting section. The arrangement represented in FIG. 26 is inverted. Thus, base 1 comprises on the top, a projecting section and the lower surface 216 of the stiffener comprises a corresponding hollow section.

Figure 27:
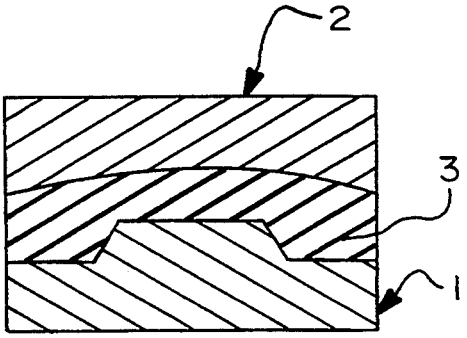

According to the previous embodiment, the lower surface 216 of stiffener 2 has a complementary shape with respect to the upper surface 115 of the base, at least at the level of the connection, but this can also be otherwise, as is represented in the variation of FIG. 27, in which the connection 3 ensures on the one hand the cooperation in shape of base 1 to the lower surface, and on the other hand, of stiffener 2 to its upper surface.

The superficial layer 112 of base 1 extends along the entire length of the latter element, including the connection zone or only in the zones where the connection 3 is not present.

According to FIGS. 1, 2 and 3, it can be seen that the superficial layer 112 is interrupted at the level of the connection. As such, the flexible connection, and thus interface 30 is directly fixed on the upper reinforcement 101 of the base.

Figure 3A:
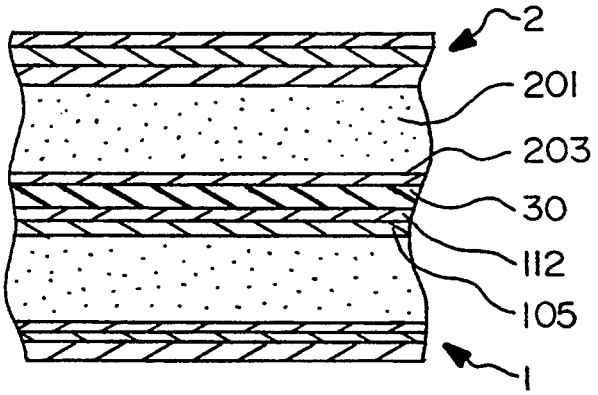
FIG. 3*a* is a variation.

FIG. 3*a* shows a variation according to which the superficial layer of 112 of the base even extends in the connection zone. Thus, interface 30 is fixed on the superficial layer of 112 of the base 1.

The rigidity of the stiffener 2 may be less or equal to that of base 1.

Figure 28:
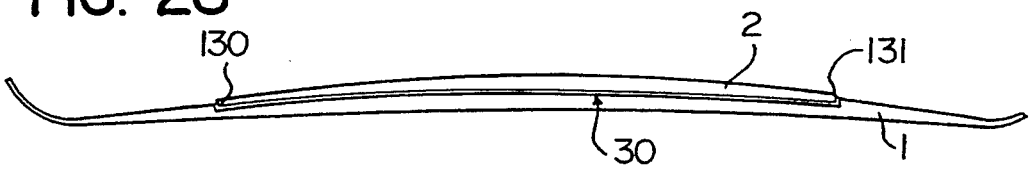
FIGS. 28 and 29 are side elevational views representing variations.
Figure 29:
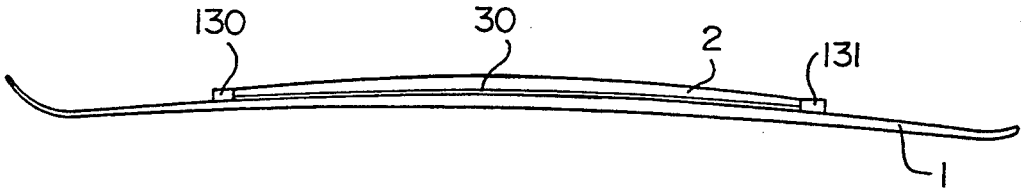

FIGS. 28 and 29 represent variations according to which the stiffener 2, mounted on a flexible interface, is retained longitudinally with respect to base 1. To this end, base 1 comprises two abutments, a first front abutment 130 and a second rear abutment 131. FIG. 28 is an embodiment according to which a stiffener is, embedded in the base. FIG. 29 represents another embodiment.

Figure 30:
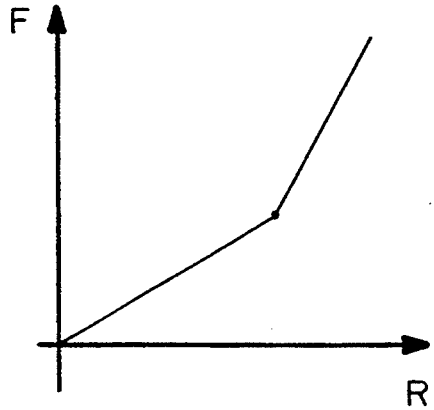
FIG. 30 is a diagram representing the rigidity of the ski in accordance with its flexion.

The embodiments of FIGS. 14 and 15 illustrates a ski whose rigidity varies in a non-linear fashion in accordance with the deformity of the ski. This ski reacts differently in accordance with the speed and the amplitude of flexion. Indeed, at rest, and during insubstantial flexion, given the presence of front (ea) and rear (er) spaces, the base is not in contact with the ends of the stiffener. On the contrary, once there is a certain amount of flexion, there is contact and action of the stiffener on the base. FIG. 30 represents in a schematic manner, the rigidity curve of the ski in accordance with its flexion.

It can also be noted that the flexible connection achieved with an elastic interface and with a film may be such that the film has a constant or variable thickness. For example, being increasingly thick frontwardly or vice versa, or even more thick simultaneously towards the front and towards the rear. One may also envision the use of a layer of flexible material whose properties are such that the rigidity is not constant along the entire layer. Indeed, it may be more flexible towards the front or vice versa.

Figure 31:
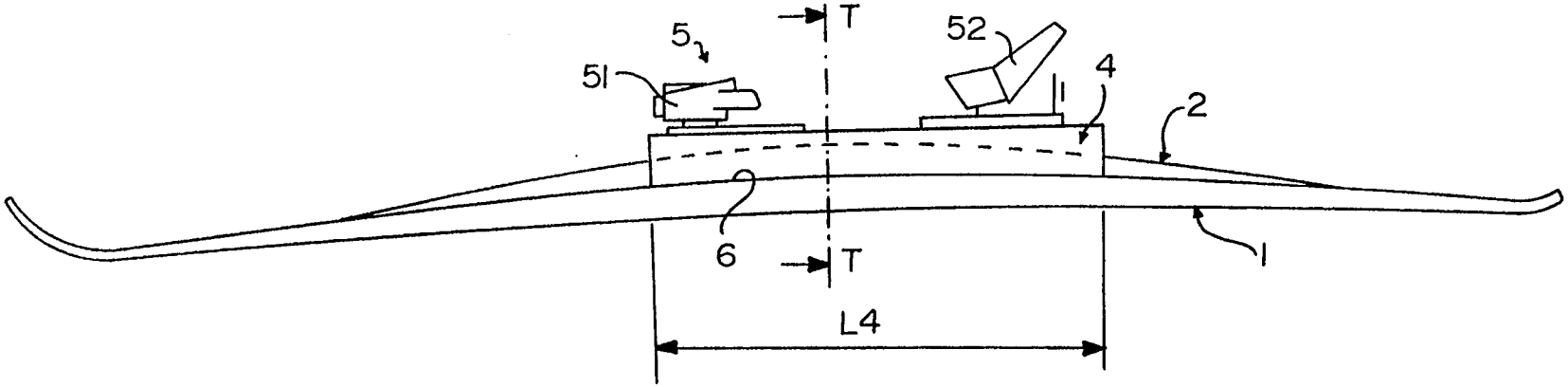
FIGS. 31 and 32 are views similar to FIG. 1 illustrating further variations.

FIG. 31 shows an improvement particularly adapted to a situation in which stiffener 2 has a width less than that of base 1.

Thus, according to this improvement, the ski comprises at least one support 4 adapted to receive the binding(s) 5 for the retention of the boot of the skier. The support 4 has the shape of a stirrup having the shape of an inverted "U", and comprises an upper wall 40 extending laterally and downwardly by two side walls 41, 42 to constitute a lower housing 43 having the shape of a hollow section extending longitudinally and adapted for the passage of stiffener 2. It must be noted that the dimensions of the housing, both width "l4" and height "h4" are greater than the width "l2" and height "h2" of the stiffener to form a space "e" necessary for the release of the latter.

According to one characteristic of the invention, the stiffener does not receive direct stresses from the skier. Thus, the support or stirrup 4 is in support only on base 1.

To this end, front ends 44 and 45 of the side walls of the support are connected to the upper surface 115 of base 1. Advantageously, the connection between the support and the base is rigid and obtained, for example, by adhesion, by welding or by any other means, such as mechanical means.

Support 4 constitutes the mechanical transmission and distribution element of the stresses of the skier on the base.

According to the embodiment of FIG. 31, support 4 receives a front binding 51 at the front and extends towards the rear along a length "L4" beneath the rear binding 52. The rear binding 52, commonly called heel attachment, is itself fixed on the rear portion of the support 4.

Figure 32:
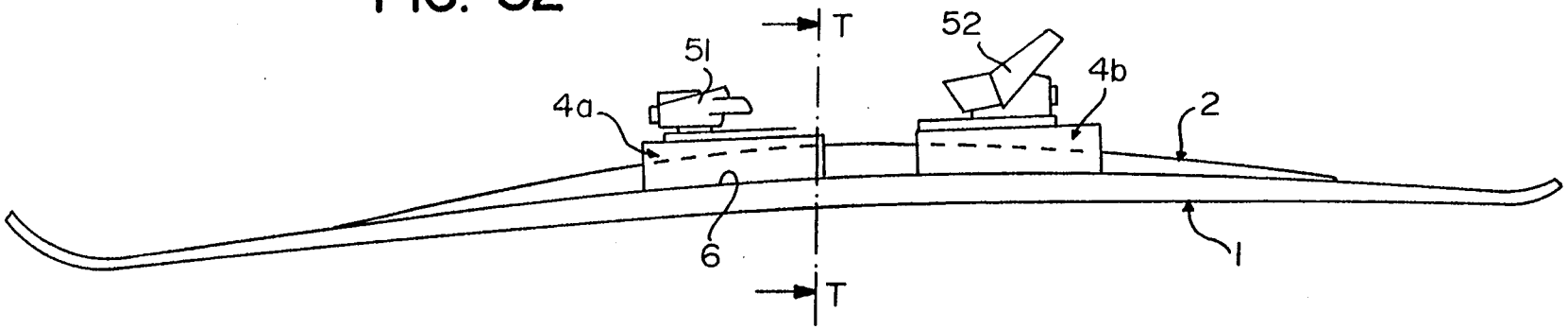

FIG. 32 represents a variation according to which the ski comprises of two supports 4 spaced from one another, the first front support 4*a* on which the front abutment 51 is fixed for retention of the boot, and a second support or rear support 4*b* on which the heel attachment 52 is fixed.

The supports 4, 4*a*, 4*b* may be an injected element made of a plastic material or may be a metallic section, a pultruded or extruded plastic element. For example, polyamides or styrenes may be used for the composition of the support.

Of course, supports 4, 4*a*, 4*b* may be of formed as a single or integral element, or may be constituted of different elements, or even may be constituted by a portion of the corresponding binding 5, 51, 52.

Figure 34:
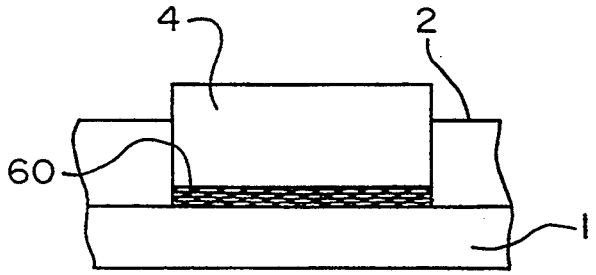
FIG. 34 is a side elevational view of the ski equipped with its support.

It must also be noted that the connection 6 between the supports 4, 4*a*, 4*b* and the base may be rigid, but may also be flexible. FIG. 34 represents such a variation in which the connection is achieved by an interface 60 made of a flexible material.

Figure 33:
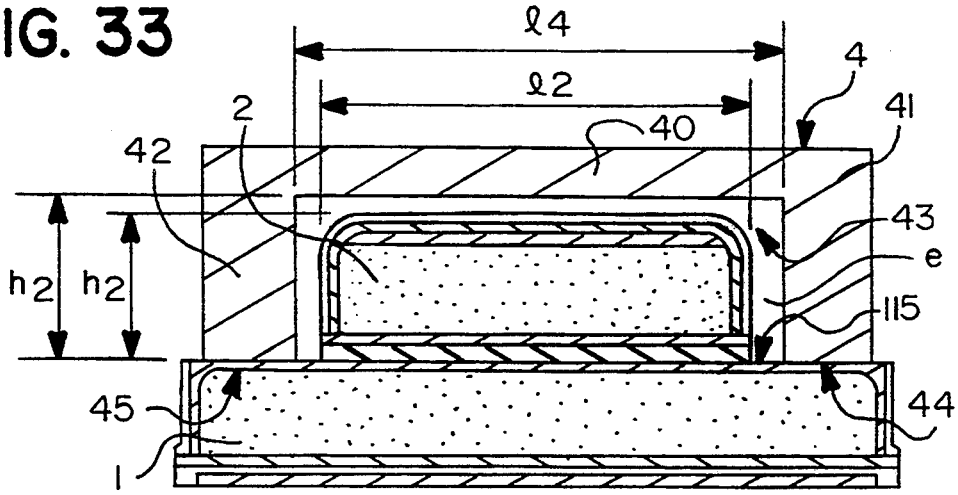
FIG. 33 is a transverse sectional view along lines T—T of FIGS. 31 and 32.
Figure 35:
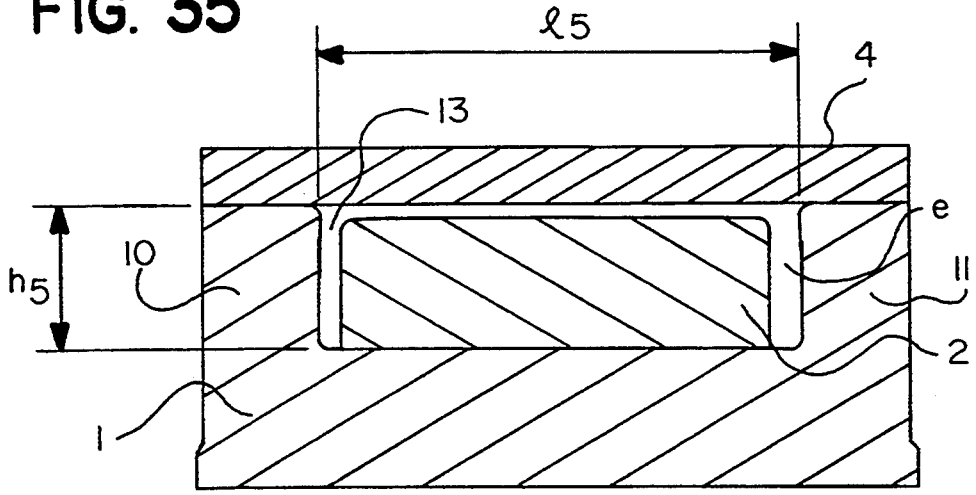
FIG. 35 is a transverse sectional view according to a simplified variation of FIG. 33.

FIG. 35 is a variation of FIGS. 33 and 34 in which stiffener 2 is integrated in base 1. For this, base 1 extends, on each side, by two lateral edges 10, 11 thus creating a housing 13 adapted for the passage of stiffener 2. The dimensions of the housing 13, both width "l5" and height "h5" are greater than the width "l2" and height "h2" dimensions of the stiffener to form, as in the case of the preceding variation, a space "e". The support 4 has, in this case, the shape of a simple plate affixed to the upper surfaces of the lateral edges 10, 11 of base 1.

Figure 36:
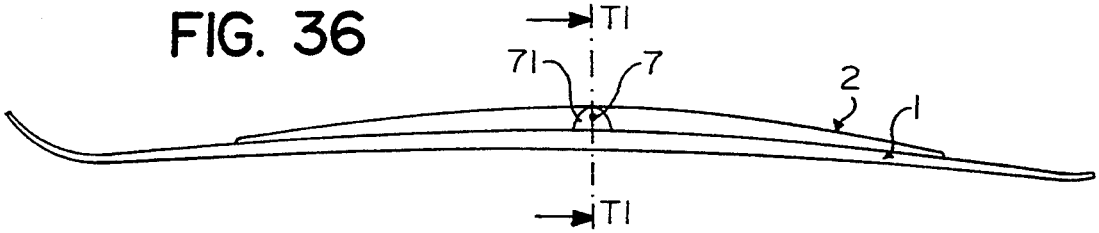
Figure 37:
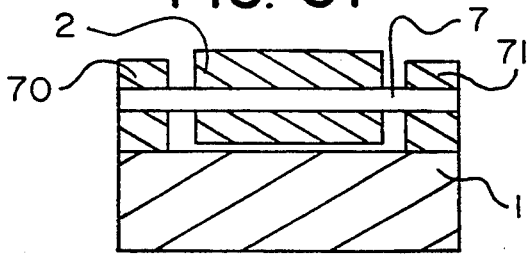
FIG. 37 is a transverse sectional view along line T1—T1 of FIG. 36.
Figure 38:
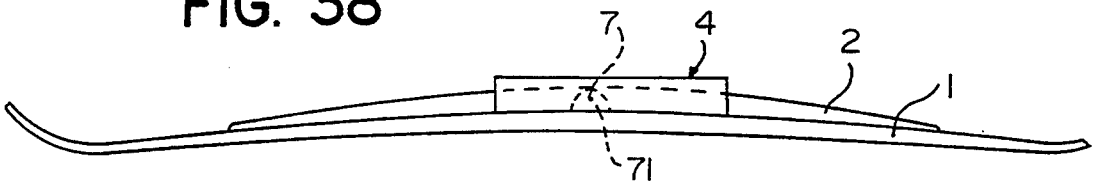

FIGS. 36 and 37 represent another variation in which stiffener 2 is connected to base 1 by a transverse journal 7. To this end, two retention side walls 70, 71 are provided, affixed to base 1. Of course, it may also be possible to provide, additionally to this variation, a support 4 for the bindings as is represented in FIG. 38.

Figure 39:
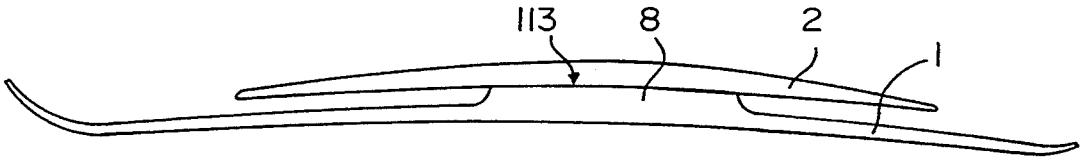

In FIG. 39, another variation is represented in a lateral view in which base 1 comprises in its central portion 113, a projection 8, to which stiffener 2 is connected; the connection being of course rigid or flexible, and in this case, achieved by an interface like that of the previous embodiments.

FIGS. 40–43 show other embodiments according to which stiffener 2 is linked to the base by its front and rear ends 209,210 by retention means constituted of intermediate elements 90, 91 for vertical and lateral retention. According to the variation of FIG. 40, the lower surface 216 of stiffener 2 is not in direct contact with the upper surface 115 of base 1, whereas, in the variation of FIG. 41, there is, indeed, contact.

In the first case, increasing the height has the effect of increasing the torque exercised by the stiffener on the base at the level of retention elements 90, 91, and this has the effect of increasing pressure of the base on the snow. One may also envision pre-stressing the stiffener such that it tends to increase the torque by using a stiffener constituted of a wing maintained in its central portion by guiding means for example.

Figure 42A:
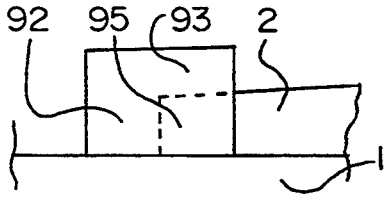
FIG. 42*a* shows a detail of the embodiment of FIG. 41.
Figure 42B:
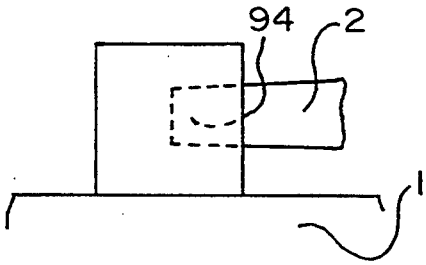
FIG. 42*b* shows a detail of the embodiment of FIG. 40.
Figure 42C:
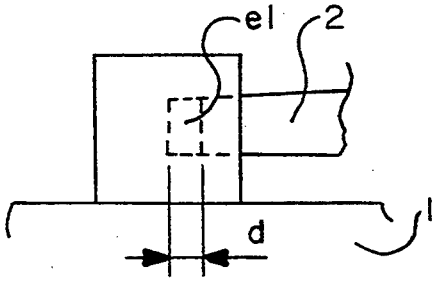
FIGS. 42*c* and 42*d* are views similar to FIG. 42*b* representing two variations.
Figure 42D:
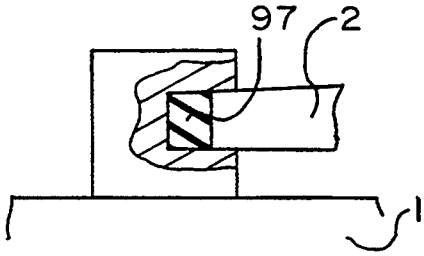

The retention means 90, 91 are constituted, each, of at least one transverse wall 92 extending upwardly and one horizontal wall 93 extending toward the center of the ski to constitute a lower housing 94 open in the direction of the center of the ski and closed laterally by two lateral retention side walls 95, 96. The ends 209, 210 of the stiffener are engaged and retained in the lower housing 94. One can also block the two ends in their corresponding housing, or block only one of the ends 209 or 210 and enable a displacement of the other end 210 or 209 in its corresponding housing, as represented in FIGS. 42*c* and 42*b*. In FIG. 42*c*, the play "e1" enables a displacement "d" of the corresponding end. But the relative displacement may occur against the action of an elastic system 97, as is represented in FIG. 42*d*.

Figure 40:
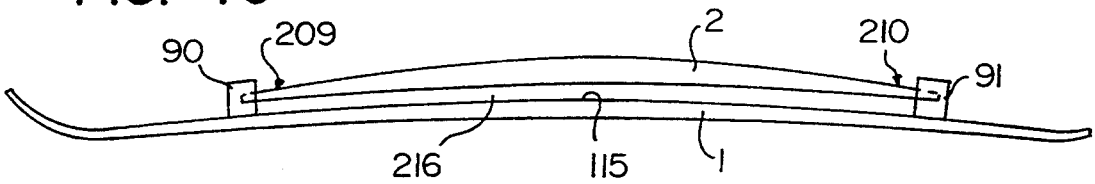
Figure 41:
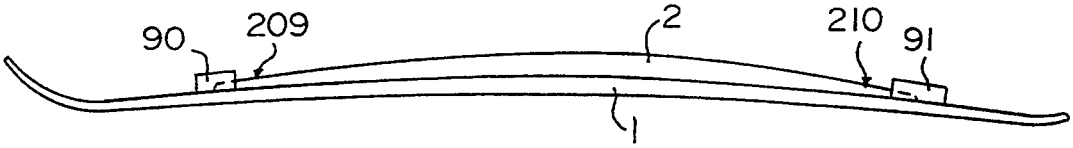
Figure 42E:
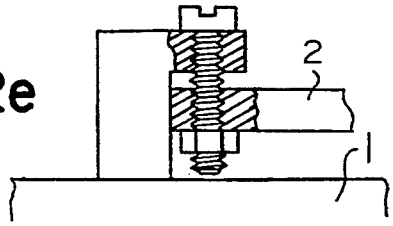
FIG. 42*e* shows a detail of the embodiment of a variation of FIG. 42*b;*

According to the embodiment of FIG. 40, it can be provided that the height of the stiffener is adjustable by adjusting means such as screws or any other means as is represented in FIG. 42*e*.

The longitudinal and vertical retention means may also be constituted by journal systems as is represented in FIGS. 44 and 44*a*. Thus, the front 209 and rear 210 ends of stiffener 2 are connected to base 1 by a transverse journal axis 90, 91 the journal 90', 91', being retained at base 1 by a journal support 80 comprising two retention side walls 81, 82.

The stirrups 4, 4*a*, 4*b* represented previously have the general shape of an inverted "U", but it may also be otherwise, as for example, has been represented in FIG. 45. According to this variation, stirrup 4 is formed by an element having the general shape of an "U" with a transverse wall 46 arranged between stiffener 2 and base 1.

It must also be noted that in the embodiments, where only the central portion of the stiffener is connected to the base, the shock absorption of the skis is done by the rubbing of ends 209 and 210 of the stiffener on the upper surface of the base.

FIG. 46 represents a variation of a ski in a transverse section according to which it comprises an external envelope 200 under which a base 1 is found with its stiffener 2. The external envelope 200 has for example, a decorative effect.

Figure 47:
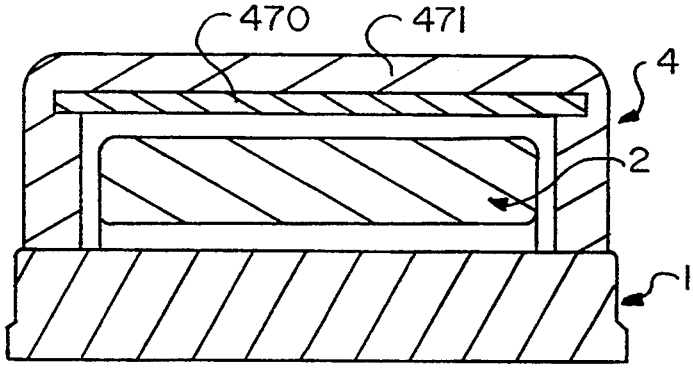
FIGS. 47–49 show two variations to the invention and particularly of the support.
Figure 48:
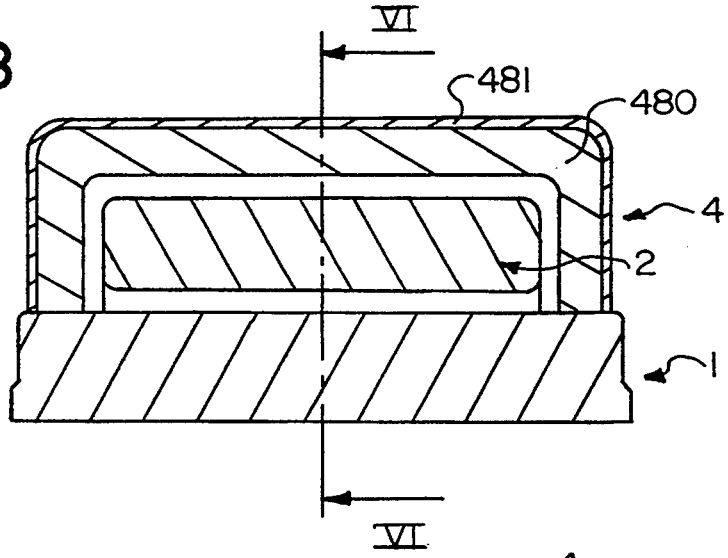
Figure 49:
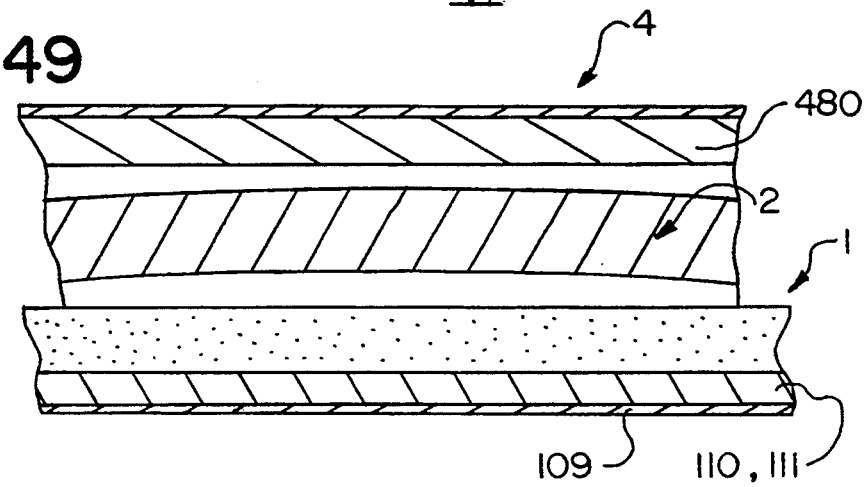

FIGS. 47–49 show a variation of the embodiment of the invention in which support 4 comprises one or several reinforcement layers so as to complete the rigidity characteristics of base 1. Such a construction may be useful especially if one wishes to reduce the height of the base/support assembly, while at the same time retain adequate mechanical characteristics.

FIG. 47 illustrates an example in which the stirrup is equipped with a reinforcement insert 470 having the shape of a plate inserted in a shell 471 shaped like an inverted "U". The insert may be a metallic plate made of an aluminum alloy, for example, or be a plate made of a composite material. The support 4 may be obtained by injection molding of the shell 48 with a plastic material. In this case, it can of course be provided that the insert is affixed to the shell during injection.

FIG. 48 illustrates an example in which the stirrup is constituted of a reinforcement shell 480 in the shape of an inverted "U" on which a decorative layer 481 is affixed. The reinforcement shell 480 may be made of one or several layers of composite materials, of any type, as mentioned previously for the construction of the reinforcement layers of the base.

Also, the decorative layer 481 may be comprised of a plastic material such as polyamide or any other material.

FIG. 49 illustrates the internal structure of the ski according to the invention in the zone in which the support 4 extends.

In this case, the structure of base 1 includes, among others, a sliding layer 109, lower reinforcement elements 110, 111, a core 105. The upper reinforcement elements do not cover the core, contrary to the example of FIG. 3*a*, and are replaced by the reinforcement element 480 of support 4.

Of course, support 4 may extend more generally beyond the assembly zone of the bindings, and this is particularly advantageous insofar as its function is not only that of having to transmit stresses from the skier on the base, but also, that of intervening in the distribution of rigidity along the ski.

Figure 50:
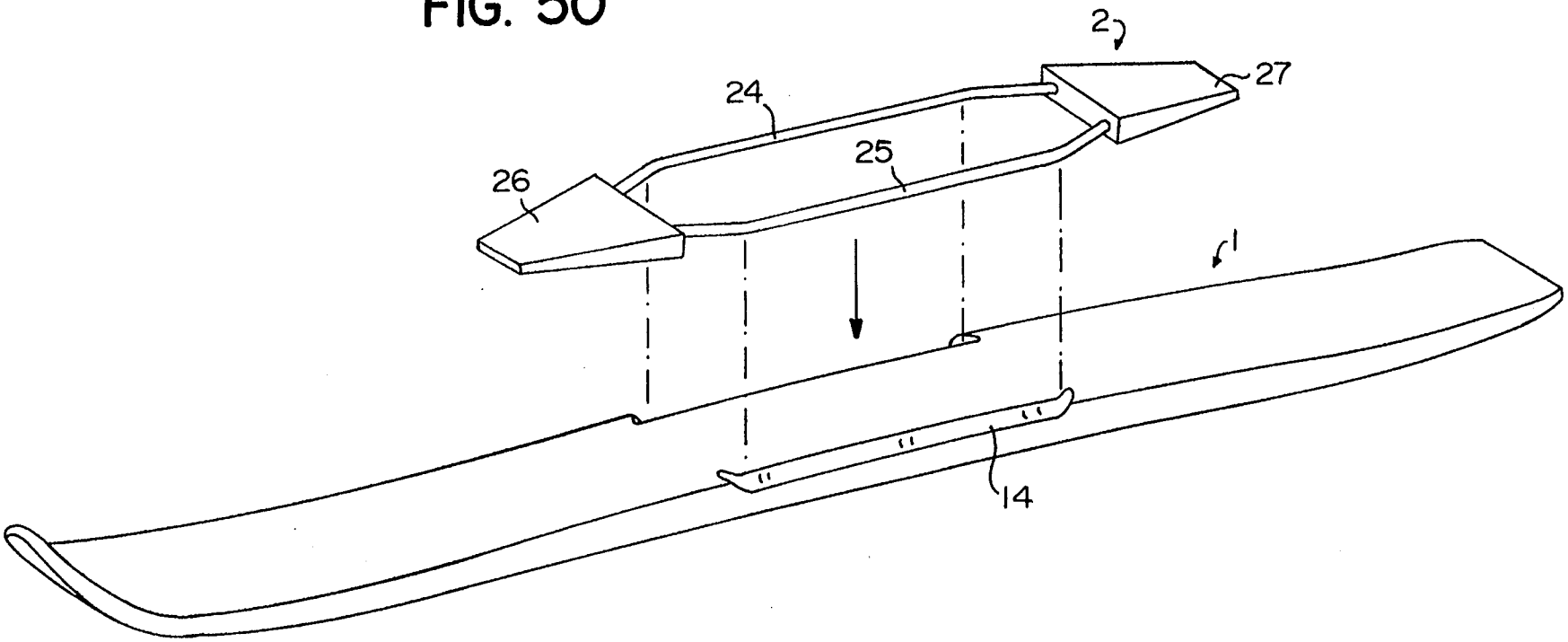
FIGS. 50–52 respectively represent in perspective, in a transverse section, and in a plane, respectively a variation of the ski according to the invention and particularly of the stiffener.
Figure 51:
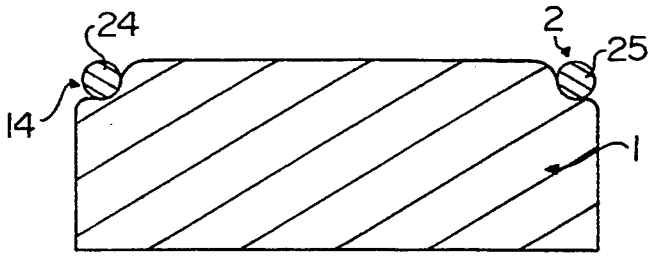
Figure 52:
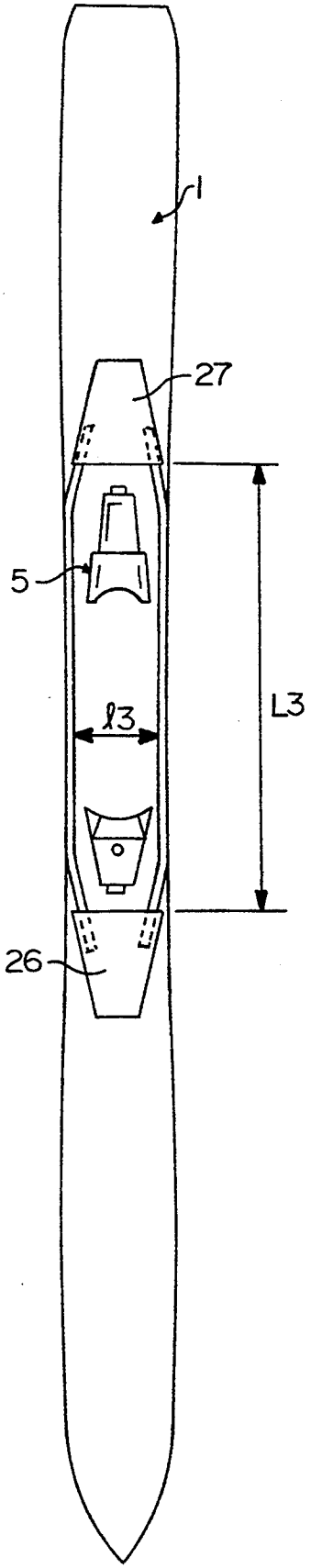

FIGS. 50–52 present an embodiment in which the stiffener has a special configuration that limits the space required by it, and thus reduces the height of the bindings with respect to the snow.

The stiffener 2 is composed of two central sections 24, 25 with a useful length L3 at least equal to or greater than the length of the zone provided for the assembly of bindings 5. Also, the sections are spaced from one another at a distance l3 sufficient for the passage of bindings 5. They may also be housed laterally, partially or totally, in housings 14 shaped to complement the base so as to best optimize the space required by them.

The front and rear 26, 27 coupling elements enable the static connection of each of the ends of sections 24, 25. Each of these elements 26, 27 is fixed by a rigid or flexible connection to base 1 of the ski.

The sections are preferably made of a composite material by pultrusion and are assembled by molding, adhesion or any other means to the coupling element 26, 27.

The latter may be of any type, shape or structure. One may also provide especially that they be constituted of a reinforcement material made of fibers and thermohardenable resin, for example.

The instant application is based upon French patent applications 90.16047 of Dec. 14, 1990, and 91.05011 of Apr. 16, 1991, the disclosure of which is hereby expressly incorporated by reference thereto, and the priority of which is hereby claimed.

Of course, this invention is not limited to the embodiments described herein, and represented as examples, but also comprises all technical equivalents and combinations, and other variations are also possible without leaving the scope of the invention.

What is claimed is:

1. A ski comprising:

a first lower assembly comprising a base, said base having a binding assembly zone and a front end raised to form a spatula, said base comprising a beam, said beam comprising:

a first upper reinforcement;

a second lower reinforcement;

a core located between said first upper reinforcement and said second lower reinforcement; and a lower sliding layer comprising two laterally opposed metallic running edges;

a second upper assembly comprising a single stiffener; and means for connecting partially said second upper assembly to said base, said means for connecting comprising a flexible interface extending beneath respective spaced portions of said second upper assembly, and wherein said single stiffener extends through and beyond said binding assembly zone of said ski.

2. A ski as defined by claim 1, wherein the stiffener has a length "L2" less than the length "L1" of the base surface in contact with the snow.

3. A ski as defined by claim 2, wherein the length "L2" of the stiffener is comprised between 50 and 100% of length "L1".

4. A ski as defined by claim 3, wherein the front end of stiffener is located between the spatula contact zone of the base and the front end of the assembly zone of the bindings.

5. A ski as defined by claim 3, wherein the rear end of the stiffener is located between the heel contact zone of the base and the rear end of the assembly zone of the bindings.

6. A ski as defined by claim 1, wherein the middle of the stiffener is located at the level of the middle of the base zone in contact with the snow.

7. A ski as defined by claim 1, wherein the middle of the stiffener is located in front of the middle of the base zone in contact with the snow.

8. A ski as defined by claim 1, wherein the middle of the stiffener is located behind the middle of the base zone in contact with the snow.

9. A ski as defined by claim 1, wherein the width "l2" of the stiffener is equal to the width "l1" of the base.

10. A ski as defined by claim 9, wherein the width "l2" of the stiffener is constant.

11. A ski as defined by claim 9, wherein the width "l2" of the stiffener is variable and changes in accordance with the longitudinal position.

12. A ski as defined by claim 11, wherein the variation of width "l2" of the stiffener is continuous.

13. A ski as defined by claim 1, wherein each of the base and the stiffener is a beam of elongated shape.

14. A ski as defined by claim 13, wherein the height "h2" of the stiffener is constant.

15. A ski as defined by claim 13, wherein the height "h1" of the base and the height "h2" of the stiffener is variable.

16. A ski as defined by claim 15, wherein the height "h2" of the stiffener decreases towards the front.

17. A ski as defined by claim 16, wherein the height "h2" of the stiffener decreases towards the rear.

18. A ski as defined by claim 1, wherein said first upper reinforcement is covered by a superficial layer.

19. A ski as defined by claim 18, wherein the superficial layer of the base is interrupted at the level of the stiffener.

20. A ski as defined by claim 1, wherein the stiffener comprises a beam, said beam comprising a first upper reinforcement, a second lower reinforcement and a core located between said first upper reinforcement and said second lower reinforcement, said first upper reinforcement of the stiffener being covered by a superficial layer.

21. A ski as defined by claim 1, wherein the at least one interface is constituted by a film of elastic material.

22. A ski as defined by claim 21, wherein the flexible material film has a variable hardness.

23. A ski as defined by claim 21, wherein the flexible material film has a variable thickness.

24. A ski as defined by claim 21, wherein the elastic or viscoelastic material film has a thickness comprised of between 0.1 and 5 millimeters.

25. A ski as defined by claim 1, wherein the interface is located only beneath the median zone off the stiffener along a length "L3" less than length "L2" of the stiffener.

26. A ski as defined by claim 1, wherein the flexible connection is constituted by two interfaces, a first front flexible interface located beneath the front end of stiffener and a second rear flexible interface located beneath the rear end of said stiffener.

27. A ski as defined by claim 1, wherein the upper surface of base cooperates with the lower surface of the stiffener by means of complementary shapes.

28. A ski as defined by claim 27, wherein the upper surface of base includes a longitudinal hollow section or a longitudinal projecting section and the lower surface of the stiffener respectively comprises a corresponding projecting section or a corresponding hollow section.

29. A ski as defined by claim 1, wherein the shape of the lower surface of the stiffener is different from the upper surface of base and the connection comprises, at its lower surface, of a shape complementary to the shape of the upper surface of the base whereas the upper surface has a shape that is complementary to the shape of the lower surface of the stiffener.

30. A ski as defined by claim 1, wherein it is comprised of at least one support or stirrup connected to base adapted to receive bindings in order to maintain the boot on the ski.

31. A ski as defined by claim 1, wherein each end of the stiffener is linked to base by an intermediate retention element.

32. A ski as defined by claim 1, wherein the width "l2" of the stiffener is less than the width "l1" of the base.

33. A ski as defined by claim 1, wherein the width "l2" of the stiffener is greater than the width "l1" of the base.

34. A ski as defined by claim 1, wherein the at least one interface is constituted by a film of viscoelastic material.

35. A ski as defined by claim 1, wherein the stiffener has a box type structure comprising a core located between an upper reinforcement and a lower reinforcement.

36. A ski as defined by claim 1, wherein the stiffener has a sandwich type structure comprising a core located between an upper reinforcement and a lower reinforcement.

37. A ski as defined by claim 1, wherein the stiffener comprises a simple section of a composite material.

38. A ski as defined by claim 37, wherein the composite material is made by the Stampable Reinforced Thermoplastic technique.

39. A ski as defined by claim 37, wherein the composite material is made by the Sheet Molding Compound technique.

40. A ski as defined by claim 37, wherein the stiffener has the form of an omega.

41. A ski as defined by claim 1, wherein the base has a box type structure.

42. A ski as defined by claim 1, wherein the base has a sandwich type structure.

43. A ski as defined by claim 1, wherein said stiffener comprises a first end and a second end and wherein a first flexible interface is positioned at said first end and a second flexible interface is positioned at said second end, said first flexible interface being spaced from said second flexible interface, whereby said means for connecting further comprises means for enabling a central portion of said stiffener to be displaceable relative to said base.

44. A ski as defined by claim 1, wherein:

said binding assembly zone comprises a front end and a rear end; and said stiffener extends beyond each of said front end and said rear end of said binding assembly zone.

45. A ski as defined by claim 1, wherein:

said base has a front contact line, a rear contact line and a predeterminate length between said front contact line and said rear contact line;

said stiffener has a front end, a rear end and a predeterminate length between said front end and said rear end; and said predeterminate length of said stiffener comprises between 50% and 100% of the predeterminate length of said base between said front contact line and said rear contact line.

46. A ski comprising:

a first lower assembly comprising a base, said base having a binding assembly zone and a front end raised to form a spatula, said base comprising a beam, said beam comprising:

a first upper reinforcement;

a second lower reinforcement;

a core located between said first upper reinforcement and said second lower reinforcement;

a second upper assembly comprising a single stiffener; and at least one connector for connecting partially said second upper assembly to said base, said at least one connector comprising at least one flexible interface extending beneath a portion of said second upper assembly and wherein, beneath at least an additional portion of said second upper assembly, said second upper assembly is free from connection to said base by means of said at least one flexible interface, and wherein said single stiffener extends through and beyond said binding assembly zone of said ski.

47. A ski as defined by claim 46, wherein the stiffener comprises a beam comprising a first upper reinforcement, a second lower reinforcement and a core located between said first upper reinforcement and said second lower reinforcement.

48. A ski as defined by claim 46, wherein said stiffener comprises a first end and a second end and wherein said at least one flexible interface comprises a first flexible interface positioned at said first end and a second flexible interface positioned at said second end, said first flexible interface being spaced from said second flexible interface, whereby said first and second flexible interfaces comprise means for enabling a central portion of said stiffener to be displaceable relative to said base.

49. A ski as defined by claim 46, wherein:

said binding assembly zone comprises a front end and a rear end; and said stiffener extends beyond each of said front end and said rear end of said binding assembly zone.

50. A ski as defined by claim 46, wherein:

said base has a front contact line, a rear contact line and a predeterminate length between said front contact line and said rear contact line;

said stiffener has a front end, a rear end and a predeterminate length between said front end and said rear end; and said predeterminate length of said stiffener comprises between 50% and 100% of the predeterminate length of said base between said front contact line and said rear contact line.

51. A ski comprising:

a first lower assembly comprising a base, said base having a front end raised to form a spatula, said base comprising a beam, said beam comprising:

a first upper reinforcement;

a second lower reinforcement;

a core located between said first upper reinforcement and said second lower reinforcement;

a second upper assembly comprising a single stiffener; and at least one connector for connecting partially said second upper assembly to said base, said at least one connector comprising at least one flexible interface extending beneath a portion of said second upper assembly and wherein, beneath at least an additional portion of said second upper assembly, said second upper assembly is free from connection to said base, and wherein a vertical space is presented at least at said additional portion of said second upper assembly for permitting vertical movement between said second upper portion and said base;

wherein said base has a front contact line, a rear contact line and a predeterminate length between said front contact line and said rear contact line;

wherein said stiffener has a front end, a rear end and a predeterminate length between said front end and said rear end; and wherein said predeterminate length of said stiffener comprises between 50% and 100% of the predeterminate length of said base between said front contact line and said rear contact line.

52. A ski as defined by claim 51, wherein said stiffener comprises a front end and a rear end, wherein said at least an additional portion of said second upper assembly comprises an intermediate portion between said front end and said rear end.

53. A ski as defined by claim 51, wherein said at least an additional portion of said second upper assembly comprises a front end portion and a rear end portion, said front end portion and said rear end portion thereby being free from connection to said base, whereby respective vertical spaces are presented between said front end portion and said base and said rear end portion and said base.

54. A ski comprising:

a base having a front end upwardly extending to form a shovel, said base having a front contact line, a rear contact line and a binding assembly zone, said base having a predeterminate length between said front contact line and said rear contact line;

a stiffener comprising at least one reinforcement element for stiffening said base, said stiffener having a predeterminate length, a front end and a rear end;

said stiffener being linked to said base along less than said predeterminate length of said stiffener at a plurality of connection means;

said plurality of connection means comprises a first flexible interface at said front end of said stiffener and a second flexible interface at said rear end of said stiffener, said second flexible interface being spaced from said first flexible interface;

said front end of said stiffener being located between said binding assembly zone and said front contact line, said rear end of said stiffener being located between said binding assembly zone and said rear contact line; and said predeterminate length of said stiffener comprising between 50% and 100% of the predeterminate length of said base between said front and rear contact lines.

55. A ski as defined by claim 54, wherein said stiffener comprises a center, said base comprises a center and wherein said center of said stiffener coincides with said center of said base.

56. A ski as defined by claim 54, wherein said plurality of connection means comprises means for enabling a central portion of said stiffener to be displaceable relative to said base.

57. A ski as defined by claim 54, wherein each of said flexible interface comprises an elastic interface.

58. A ski as defined by claim 54, wherein each of said flexible interface comprises a viscoelastic interface.

* * * * *